United States Patent [19]

Saigne

[11] 4,455,708

[45] Jun. 26, 1984

[54] DOOR CLOSER HAVING A BRAKING MECHANISM COMPRISING AN ELASTOMERIC BAG

[75] Inventor: Gérard Saigne, Larche, France

[73] Assignee: Paumellerie Electrique, Larche, France

[21] Appl. No.: 390,364

[22] Filed: Jun. 21, 1982

[30] Foreign Application Priority Data

Jun. 23, 1981 [FR] France ..... 81 12274

[51] Int. Cl.[3] ..... E05F 3/04

[52] U.S. Cl. ..... 16/56; 16/58; 16/62; 16/79; 16/82; 92/63; 92/136; 92/142

[58] Field of Search ..... 16/56, 58, 62, 64, 65, 16/69, 72, 79, 82, 84, DIG. 9; 92/63, 134, 136, 142; 188/268, 298

[56] References Cited

U.S. PATENT DOCUMENTS 3,021,926 2/1962 Wasdell ..... 188/298

3,259,937 7/1966 Korikov ..... 16/58 X 4,115,897 9/1978 Zunkel ..... 16/62 X 4,349,939 9/1982 Tillmann ..... 16/58 X

*Primary Examiner*—Fred Andrew Silverberg

*Attorney, Agent, or Firm*—Robert E. Burns; Emmanuel J. Lobato; Bruce L. Adams

[57] ABSTRACT

A door closer comprising at the end of one of two pivotally interconnected arms a closing device whose housing encloses a cylindrical piston driven by the arm through a rack-and-pinion system. On each side of this piston a return spring and a bag, filled with an incompressible but deformable viscous gum placed in a hollow piston biased elastically toward the cylindrical piston are placed on each side of the first-mentioned piston. The hollow piston has a diameter distinctly larger than the diameter of the first-mentioned piston, and the combined actions of this difference in diameters and of the viscosity of the gum ensure an effective braking of the return of the first-mentioned piston.

10 Claims, 5 Drawing Figures

DOOR CLOSER HAVING A BRAKING MECHANISM COMPRISING AN ELASTOMERIC BAG

Door closers employed at the present time comprise two arms which are pivoted together and are adapted to be pivotally mounted, one on the door frame, and the other on the door proper, one of these arms being associated with an automatic closing device. Various types of closing devices have been constructed, but they all comprise usually a piston moving inside a housing containing oil and connected to the arm by a rack-and-pinion system or the like. A spring biases the piston, and consequently the arm, to the closing position, but this movement is braked or retarded by the pressure of the oil in the housing since a constricted passage limits the circulation of the oil in this direction.

Such devices must be perfectly sealed notwithstanding the passage of the axis of the arm, since any escape of oil completely adversely affects their operation. It is therefore essential to construct them in a very precise manner with very narrow tolerances and this results in high cost.

An object of the present invention is to overcome this situation by providing a door closer which no longer requires the use of precise parts and in which the problem of the seal is practically eliminated.

The invention provides indeed a door closer whose closing device comprises, in opposed relation to the spring, a bag, containing a viscous gum which is deformable but incompressible, placed in a hollow piston which is biased elastically to an adjusted position.

The sole seal required is consequently that of the closure of the bag. The other parts must merely be capable of moving with respect to each other with a minimum of friction. The manufacture can therefore be simplified and yet such a device can remain precise and effective even after prolonged use.

Preferably, the gum contained in the bag is a visco-elastic elastomeric gum based on silicone. Such a gum, whose viscosity is variable and which reacts suddenly under the action of impacts, such as that of the piston biased by the spring, first of all ensures a considerable absorption of energy and then, having again become fluid and viscous but still incompressible, ensures an even braking of the piston. The safety and effectiveness of the device are thus improved.

The ensuing description of one embodiment, given merely by way of example and shown in the accompanying drawings, will bring out the features and advantages of the invention.

Figure 1:
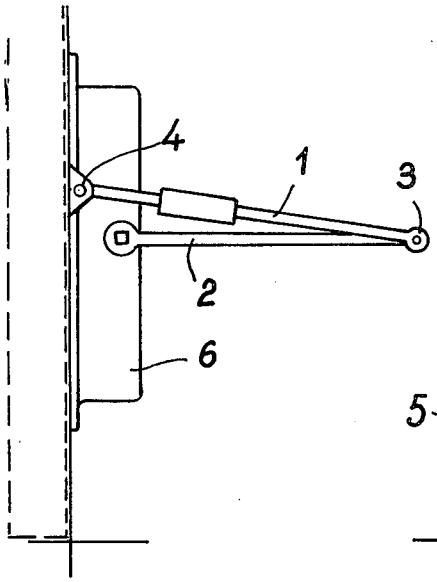
FIGS. 1 and 2 show diagrammatically a door closer respectively in the position for closing and in the position for opening the door.

As shown in FIG. 1, the door closer according to the invention comprises two arms, respectively 1 and 2, which are pivoted together at 3. The first arm 1 preferably has an adjustable length and carries at its free end a pin 4 whereby it may be pivotally mounted, for example as in the illustrated embodiment, on the frame 5 of the door. The second arm 2 is fixed to a closing device 6 for the door carried, in the presently-described embodiment, by the door proper 7 of the door structure.

The arm 2 is rigid at its end with a pin 8 which extends therethrough and also through a housing 10 of the closing device 6. Inside the housing 10, the pin 8 is rigid with a gear pinion 12 which is meshed with a rack 14 carried by a cylindrical piston 16 coaxial with the housing 10. The rod 18 of the piston 16 is guided in a cylindrical sleeve 20 rigid with the end wall 21 of the housing 10. Further, a spring 22 mounted between the wall 21 and the piston 16, tends to bias the latter away from the wall 21 and toward the opposite end of the housing 10.

The piston 16 is moreover guided in its movement by a relatively fixed sheath 24 which is fixed in the housing 10 and includes a cavity 25 allowing the passage of the pin 8 and the pinion 12. At the end opposed to the spring 22, the sheath 24 includes a step 26 which defines therebetween and the housing 10 an annular space 28 in which the lateral wall of a hollow piston 30 of large diameter is slidable. The piston 30 is guided by the inner wall of the housing 10 and also centers the end of a central sleeve 32 which is fitted moreover on an annular projection 34 carried by the end wall 36 of the housing 10.

The sleeve 32 has an outer shoulder 38 and a spring 40, which bears against this shoulder, biases the piston 30 toward the sheath 24.

As the sleeve 32 is hollow, it carries at its inner end the end filler portion 42 of a bag 44 placed inside the piston 30 and filled with a viscous and incompressible fluid 46.

In use, the end portion 42 is closed by a fluidtight screw 43 while the annular projection 34 of the wall 36 which carries the sleeve 32 is closed by an adjusting screw 48 which is rigid with a control knob 50. The adjusting screw 48 abuts against the sleeve 32 and thus determines the position of the filler portion 42, i.e. the position of the bag 44 relative to the sleeve 24.

The viscous fluid 46 contained in the bag 44 is preferably a visco-elastic elastomeric gum and in particular a non cross-linked silicone gum which has a constancy of viscosity within a wide temperature range and a high energy absorbing capacity. It will be understood that various components may be added to this gum so as to vary its viscosity in accordance with the type of door closer to be constructed. Thus, it is for example possible to add to the gum industrial glycerine, white oleic acid or any other product.

The bag 44 is made from a fluidtight material which resists repeated deformations at various temperatures, such as a fluoro-carbone elastomer or some other product.

Figure 4:
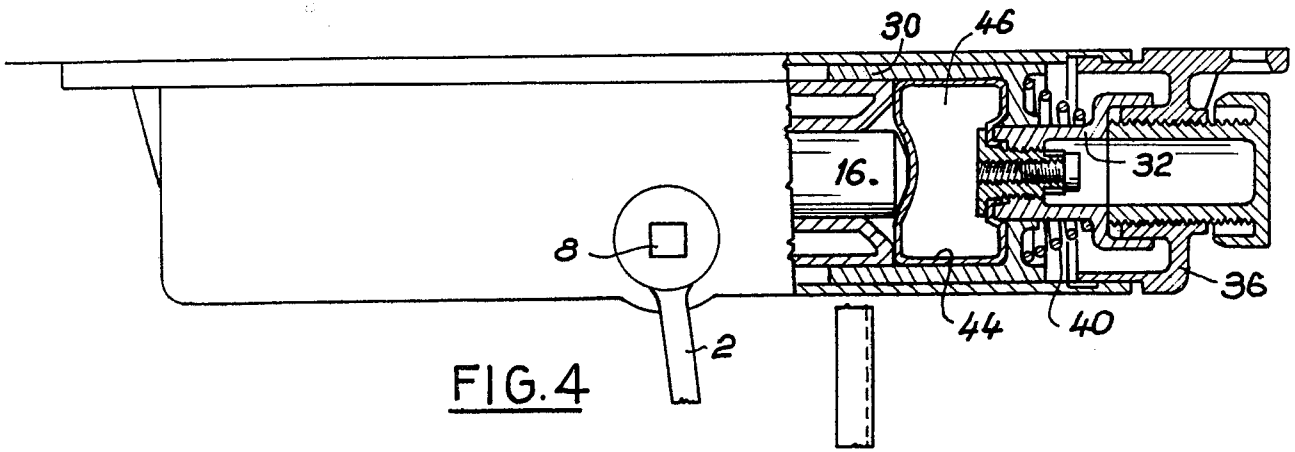
FIG. 4 is a view similar to FIG. 3 of the closing device when the door is closed.

When the door is closed, i.e. in the position shown in FIGS. 1 and 4, the arm 2 is substantially perpendicular to the door 7 of the door structure and the arm 1 is slightly inclined relative to the frame 5. Further, the piston 16 is in its position the most remote from the wall 21, i.e. in contact with the bag 44 as shown in FIG. 4.

Figure 2:
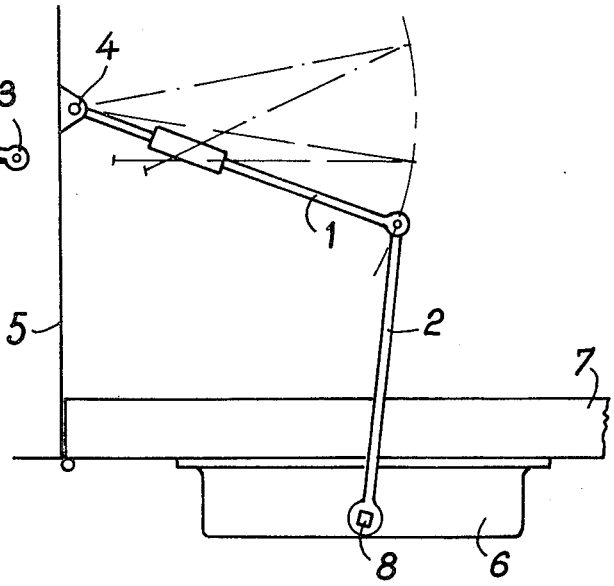
Figure 5:
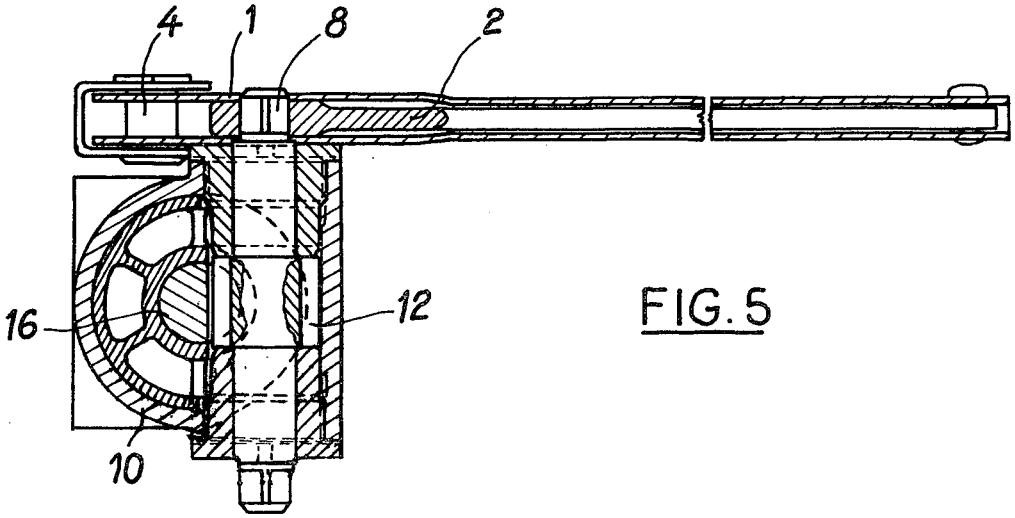
FIG. 5 is a vertical sectional view showing the connection between the arm and the closing device.
Figure 3:
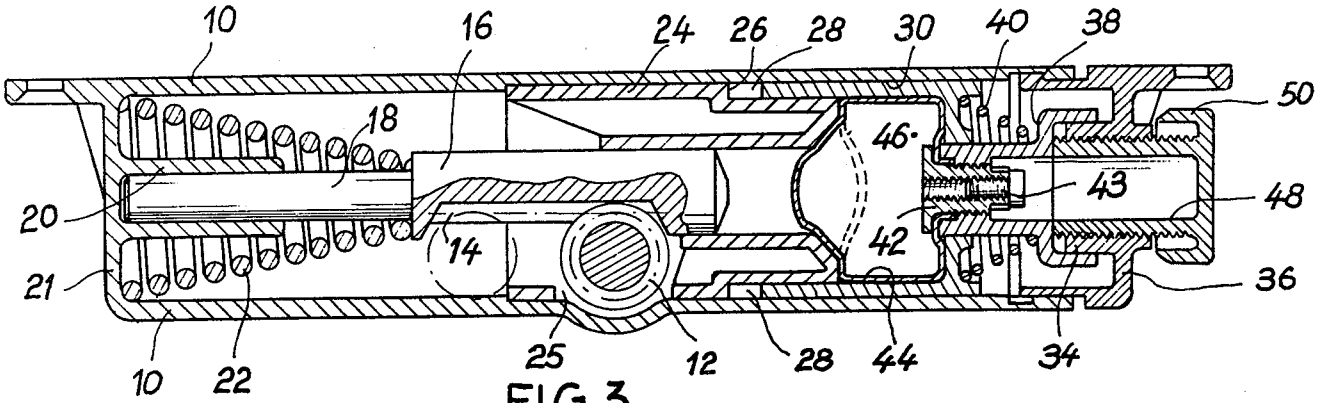
FIG. 3 is a horizontal sectional view of the closing device of the door closer of FIG. 2.

When the door 7 pivots to the open position shown in FIG. 2, the two arms 1 and 2 pivot with respect to each other and move apart and the pin 8 connecting the arm 2 to the housing 6 rotates on itself in the counter-clockwise direction, as viewed in FIGS. 3 and 4. Consequently, the pinion 12 drives the rack 14 and shifts the piston 16 in the direction toward the end wall 21 of the housing 10 against the action of the spring 22. The bag 4, which is released from the contact of the piston 16 but remains subjected to the action of the spring 40 which biases it toward the sheath 24, then assumes the shape shown in FIG. 3, i.e. forms a central projection and marries up with the substantially conical shape of the end of the sheath 24.

As soon as the opening force exerted on the door ceases, the spring 22 biases the piston 16 in the direction toward the bag 44 so that the rack 14 causes the pivot pin 8 of the arm 2 to rotate in the opposite direction. The piston 16 then suddenly abuts against the central projection of the bag 44 and urges the contents of the bag in the direction of the end portion 42. As the viscous fluid 46 is incompressible, the continuation of the movement of the piston 16 simultaneously urges the bag 44 and the piston 30 against the action of the spring 40 in the direction of the opposite end wall 36.

As the fluid 46 is viscous and the piston 30 has a diameter distinctly larger than that of the piston 16, the latter is progressively braked and is then on the point of stopping.

When, as in the preferred embodiment, the viscous gum 46 is a visco-elastic silicone gum capable of suddenly hardening under the effect of impact, the assembly comprising the bag 44 and the viscous gum 46 absorbs a very large amount of energy of the piston 16 and practically stops it during an extremely short period, of the order of some tenths of a second. However, the visco-elastic gum 46 rapidly resumes a viscous and fluid condition so that the continuation of the displacement of the piston 16 under the action of the pinion 12 is possible although considerably braked or retarded by the necessity to displace all of the gum and the piston 30 against the action of the spring 40.

In the course of this displacement of the piston 16 and of the pinion 12, the arm 2 has, on one hand moved closer to the arm 1 as the pivotal connection 3 progressively closes, and, on the other hand, has pivoted with this arm about the pivot pin 4 of the arm 1 from the position shown in full line in FIG. 2, to the end position shown in dotted lines. In the last-mentioned position, i.e. when the door is in the vicinity of the frame, the piston 16 of the closing device is practically in its end position and is ready to stop. At this moment, the two arms have folded to such position that the forces which are exerted on their pivotal connection tend to urge the arm 2 toward its position perpendicular to the frame 5 of the door. There then occurs a release of this pivotal connection which completes the closure of the door and possibly allows the half-turn bolt of the door latch or lock to engage in the keeper.

The closing device is then in its position of rest, i.e. the bag 44 has resumed its initial position. The device is ready to be used again.

In such a device, the sole fluid employed is the gum contained in the bag 44. The sole sealing device required is therefore that which is placed between the filler end portion 42 and the screw 43 closing the latter. The other parts are merely required to move easily with respect to each other and may easily be manufactured with relatively wide tolerances. Consequently, the housing 10 and the parts contained therein may be made from a plastics material having a good coefficient of friction. For example, the housing 10 is made from a polyamide or polyester and the piston 30 which slides in this housing is made from a polyacetal. It will be understood that these parts may also be manufactured from metal, for example from an aluminium alloy or a zinc alloy (Zanak) since no machining operation is required.

The housing 10 is preferably made in a single piece and is simply open at its end. The wall 36 which supports the adjusting screw 48 is then formed by a detachable cap which is fixed to the wall of the housing 10, for example by a bayonet fixing system. The device can thus be dismantled at any moment for inspection and maintenance. It is also possible, at any moment, to modify its adjustment and to have access to the interior of the bag 44, either for filling it or for modifying the viscous product contained in the bag and thus regulate the braking intensity, which is related to the viscosity of the gum, and/or take up play and wear.

The invention consequently provides an inexpensive device whose operation is sure and reliable and which is particularly resistant to wear and fatigue.

Having now described my invention what I claim as new and desire to secure by Letters Patent is:

1. In a door closer comprising pivotally interconnected arms and a closing device mounted at one end of one of the arms and comprising a closed housing, a first piston mounted in the housing and movable between an open door position and a closed door position, a return spring for biasing the piston to the closed door position, means drivingly connecting said one arm to the piston so that the piston is displaced by the arm to said open door position when the door opens in opposition to the action of the return spring, and means for braking the displacement of the piston toward said closed door position under the action of the return spring; the improvement wherein said braking means comprises a sealed bag containing a viscous gum which is deformable but incompressible, a hollow second piston containing the bag and means for elastically biasing the second piston in a direction opposite to said return spring and toward an adustable position, wherein the bag is abutted by the first piston and the gum is deformed as the first piston approaches the door closed position.

2. A door closer according to claim 1, comprising a sheath fixed in the housing, the first piston being slidable in the cylindrical sheath and the second piston being of larger diameter than the first piston and slidably mounted in the housing so that the displacement of the second piston is a function of the difference between the diameters of the two pistons.

3. A door closer according to claim 2, wherein the sheath for guiding the first piston comprises a peripheral step which defines with the housing an annular space in which a lateral wall of the hollow second piston is slidable.

4. A door closer according to claim 2, wherein the sheath for guiding the first piston comprises, in confronting relation to the bag, an outwardly divergent substantially frusto-conical end portion.

5. A door closer according to claim 1, wherein the bag which contains the viscous gum comprises a filler end portion which extends through a bottom of the hollow second piston.

6. A door closer according to claim 5, comprising a sleeve which is fixed on the filler end portion of the bag and extends through the bottom of the hollow second piston and is provided with a shoulder, said elastically biasing means comprising another return spring for the hollow second piston bearing against said shoulder.

7. A door closer according to any one of the preceding claims, comprising a screw for adjusting the position of the bag relative to the housing and screwed in an end wall of the housing.

8. A door closer according to any one of the claims 1, 2, 5 or 6, wherein the viscous gum is a non-cross-linked visco-elastic silicone gum having a large energy absorbing capacity and a constant viscosity within a wide temperature range.

9. A door closer according to any one of the claims 1, 2, 5 or 6, wherein the bag is made from a fluorocarbon elastomeric material.

10. A door closer according to any one of the claims 1, 2, 5 or 6, wherein the housing has an end in the vicinity of the hollow second piston which end is formed by a detachable cap.

* * * * *